US010450715B2

(12) United States Patent
Marshall

(10) Patent No.: US 10,450,715 B2
(45) Date of Patent: Oct. 22, 2019

(54) POWERED LIFTING STATION FOR AND METHOD FOR LIFTING A SLAB FOUNDATION

(71) Applicant: Frederick S. Marshall, Arlington, TX (US)

(72) Inventor: Frederick S. Marshall, Arlington, TX (US)

(73) Assignee: Frederick S. Marshall, Arlington, TX (US)

( * ) Notice: Subject to any disclaimer, the term of this patent is extended or adjusted under 35 U.S.C. 154(b) by 0 days.

(21) Appl. No.: 16/173,649

(22) Filed: Oct. 29, 2018

(65) Prior Publication Data

US 2019/0127944 A1 May 2, 2019

Related U.S. Application Data

(60) Provisional application No. 62/578,950, filed on Oct. 30, 2017.

(51) Int. Cl.

| | |
|---|---|
| ***E02D 35/00*** | (2006.01) |
| ***E04G 13/00*** | (2006.01) |
| ***E02D 27/01*** | (2006.01) |

(52) U.S. Cl.
CPC ..... *E02D 35/005* (2013.01); *E02D 27/01* (2013.01); *E04G 13/00* (2013.01)

(58) Field of Classification Search
CPC ..... E02D 27/01; E02D 35/005; E02D 35/00; E04G 23/065; E04G 23/06; B66F 11/00
See application file for complete search history.

(56) References Cited

U.S. PATENT DOCUMENTS

| | | | | |
|---|---|---|---|---|
| 7,744,316 | B2 * | 6/2010 | Kaufman | E02D 35/00 405/230 |
| 8,407,898 | B2 | 4/2013 | Marshall | |
| 8,834,072 | B1 | 9/2014 | Donald | |
| 9,376,799 | B2 * | 6/2016 | Ouellet | E04B 1/34321 |
| 2002/0062622 | A1 * | 5/2002 | Bell | E02D 35/00 52/741.15 |
| 2011/0023384 | A1 * | 2/2011 | Marshall | E02D 27/32 52/125.1 |

* cited by examiner

*Primary Examiner* — Christine T Cajilig

(74) *Attorney, Agent, or Firm* — Bracewell LLP; James E. Bradley

(57) ABSTRACT

A technician positions a form with a threaded aperture on a pier. Concrete is poured around the form to create a slab foundation. A fixture is then placed on the slab foundation, the fixture having a polygonal anti-rotation member that inserts into a polygonal upper end of the form. The fixture has an upward extending fixture stop member. A threaded rod with a tool adapter on its upper end is screwed into the threaded aperture. The adapter has an adapter stop member extending laterally relative to the fixture stop member. A power tool rotates the adapter to lift the slab foundation until the adapter stop member swings into contact with the fixture stop member. The technician then removes the adapter, places the adapter stop member adjacent an opposite side of the fixture stop member, then again rotates the adapter.

19 Claims, 3 Drawing Sheets

POWERED LIFTING STATION FOR AND METHOD FOR LIFTING A SLAB FOUNDATION

CROSS-REFERENCE TO RELATED APPLICATION

This application claims priority to provisional application Ser. No. 62/578,950, filed Oct. 30, 2017.

FIELD OF DISCLOSURE

The present disclosure relates to a powered mechanism that lifts and supports above ground a newly poured slab foundation.

BACKGROUND

Many structures are built on foundations or slabs made of concrete poured on a grade of soil. Changes in the weather and moisture levels in the soil may cause the foundation to buckle or crack. The shifting of the soil occurs for a variety of reasons, including uneven changes in the water content of the supporting soil, uneven compacting of the soil, and uneven loads placed on the grade. Various techniques are employed to level and repair foundations that have been damaged.

Another approach has been to pour the foundation on a prepared grade, then raise the foundation a selected distance above the grade before building a structure on the foundation. In this technique, piers are first installed in soil below the grade at various positions. The upper end of each pier will be at or near the grade level. Then, forms are placed on the piers to serve as lifting stations after concrete is poured. A slab foundation may have numerous lifting stations to provide adequate support during and after being lifted. A hydraulic jack or screw jack may be employed with each lifting station to lift the slab foundation. To avoid damage to the foundation while it is being lifted, it is important to keep the foundation substantially level.

One technique employing screw jacks will utilize a threaded rod at each lifting station. One or more workers rotate the threaded rods with large wrenches as the foundation is being lifted. The workers must move from lift station to lift station, each time incrementally lifting the slab a short distance to maintain it level.

SUMMARY

A method for lifting a slab foundation comprises installing at least one pier into a grade. A form with a threaded aperture and polygonal upper end will be placed over the pier. Concrete is then poured around the form and allowed to harden into a slab foundation. The form defines a cavity with a polygonal receptacle at an upper side of the slab foundation. A fixture will be placed on the upper side of the slab foundation, the fixture having a polygonal anti-rotation member that inserts into the polygonal receptacle and has a longitudinal axis. The fixture has an upward extending fixture stop member laterally offset from the axis. A technician inserts a threaded rod into the cavity and rotates the threaded rod through the threaded aperture. A tool adapter is positioned on an upper end of the threaded rod, the adapter having an adapter stop member extending laterally relative to the axis. A tool rotates the tool adapter and the adapter stop member about the axis, lifting the slab foundation an increment until the adapter stop member engages a stop side of the fixture stop member. Then, the technician removes the adapter and places the adapter stop member adjacent a start side of the fixture stop member. The tool then rotates the adapter again, lifting the slab foundation a further increment until the adapter stop member again engages the first side of the fixture stop member.

In the embodiment shown, rotating the tool adapter comprises rotating the adapter stop member less than 360 degrees about the axis. Installing the fixture on the upper side of the slab foundation comprises inserting the polygonal anti-rotation member into the polygonal upper end of the form.

Installing the fixture on the upper side of the slab foundation may further comprise providing the fixture with an upward-extending safety guard on an opposite side of the anti-rotation member from the fixture stop member and inward from an outer edge of the fixture. The space between the outer edge of the fixture and the safety guard defines a foot rest for a worker on the fixture.

After lifting the slab foundation to a selected height, the fixture is removed from the slab foundation. A cover may then be placed on the polygonal receptacle and the threaded rod.

After placement on the pier, a lower portion of the form will be supported on the grade. The step of rotating the threaded rod through the threaded aperture comprises rotatably engaging a lower end of the threaded rod with an upper end of the pier. Installing the fixture and inserting the threaded rod comprises extending the threaded rod through an aperture in the anti-rotation member.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

Figure 1:
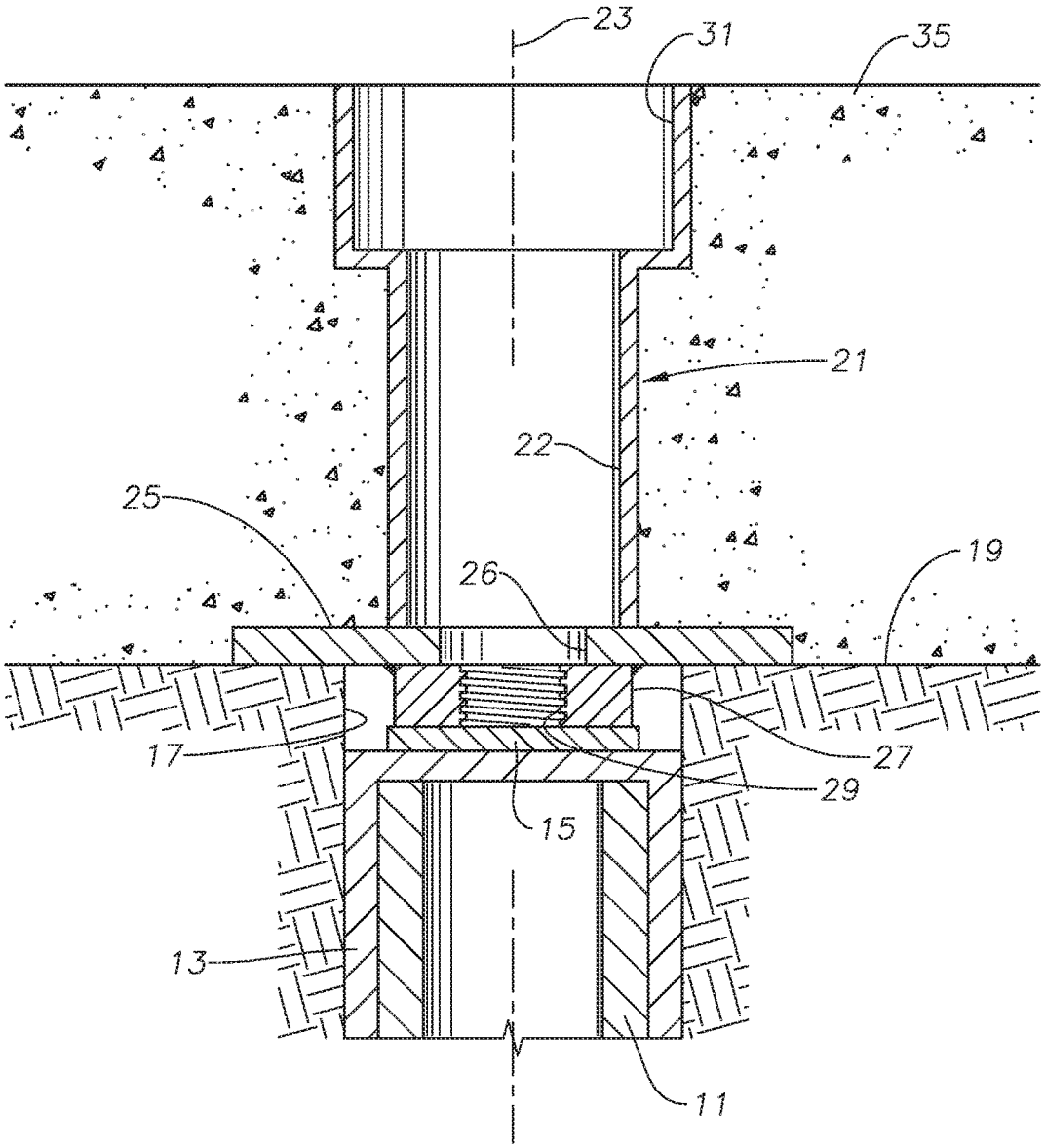
FIG. 1 is a sectional view of part of a slab foundation containing a form for a powered lift station in accordance with this disclosure.

Referring to FIG. 1, initially a number of supporting members or piers 11 (only one shown) will be embedded at selected distances apart from each other. FIG. 1 shows pier 11 to be a steel shaft that has helical flights (not shown) attached to it. The shaft of pier 11 is embedded into the ground by rotating it, which causes the helical flights to pull the shaft of pier 11 deeper. Alternately, the supporting member could be other types, such as concrete segments driven into the ground. Pier 11 has a cap 13 on its upper end. A bearing plate 15 optionally may be fixed on top of the upper side of cap 13. In this example, bearing plate 15 is recessed within a cavity 17 formed in the earth by the embedded pier 11. Bearing plate 15 is illustrated to be a short distance below grade level 19 of the earth or ground.

A lift station will be located at each pier 11. The lift station includes a concrete pouring form 21, which may be of metal, placed on grade 19 over cavity 17. Form 21 includes a tubular intermediate portion 22 with a longitudinal axis 23. Tubular portion 22 may be cylindrical as shown, or it could be polygonal. In this example, form 21 also has a nut support plate 25 welded to a lower end of tubular intermediate portion 22. Nut support plate 25 may be perpendicular to axis 23 and extend laterally beyond tubular intermediate portion 22. Nut support plate 25 has a hole 26 through it that is located on axis 23. Form 21 includes a nut 27, shown welded to the lower side of nut support plate 25. Nut 27 has a threaded aperture 29 on axis 23. There are various ways to provide form 21 with a non-rotating threaded aperture other than the example shown.

Form 21 has a polygonal upper section 31 extending upward from tubular intermediate portion 22. Polygonal upper section 31 has at least one flat side, and in this example, it has four, forming a rectangular opening centered on axis 23.

Figure 2:
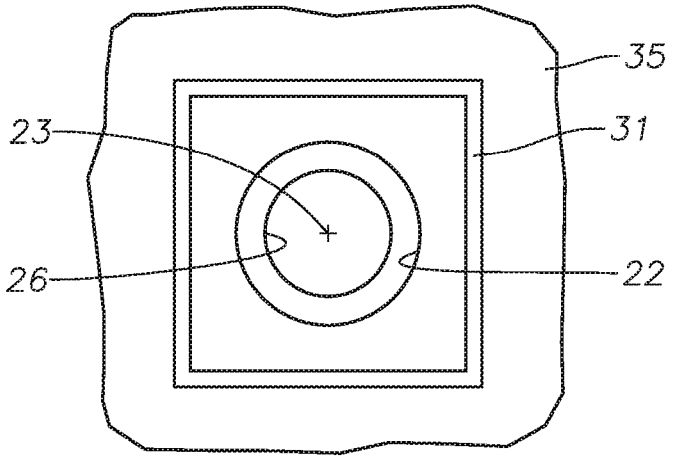
FIG. 2 is a top view of the slab foundation and form of FIG. 1.

After placing form 21 over cavity 17, the operator pours a concrete slab 35 on grade 19, which may be covered with a sheet that prevents bonding of the concrete to grade 19. In this example, the concrete bonds to tubular intermediate portion 22, the outer portion of nut support plate 25 and polygonal upper section 31. FIGS. 1 and 2 illustrates the lift station after slab 35 has been poured.

Figure 3:
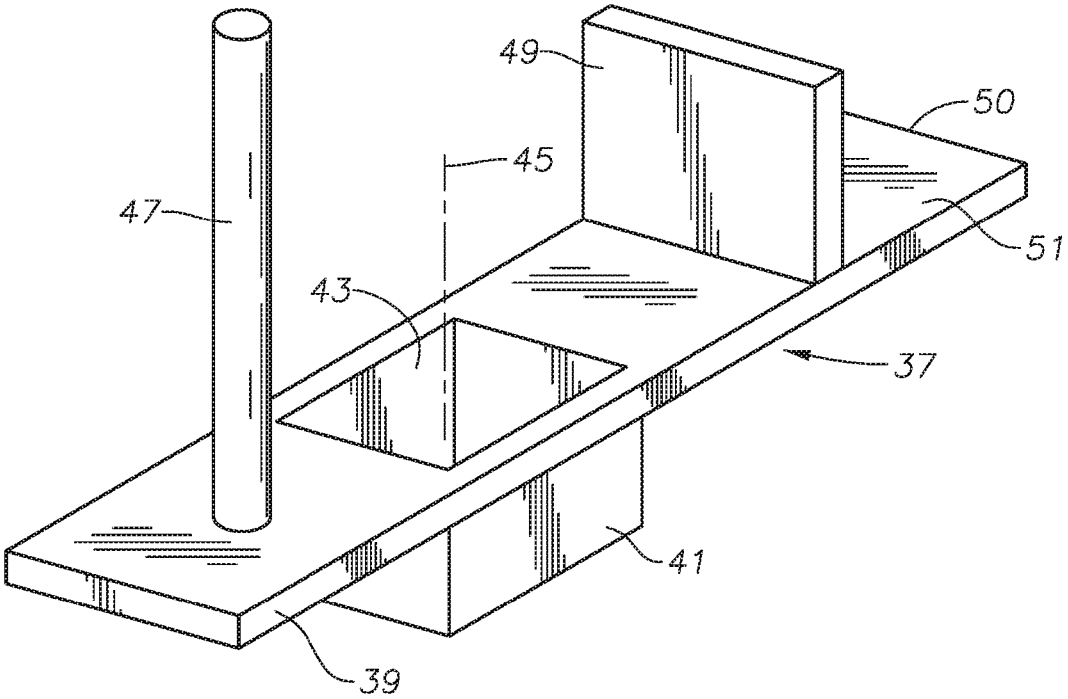
FIG. 3 is a perspective view of a work station fixture for placement on top of the form of FIG. 1.

FIG. 3 shows a lift station fixture 37 that is employed after slab 35 has hardened. Fixture 37 has a flat plate 39, which may be rectangular, as shown. An anti-rotation member 41 is secured to or integrally formed with plate 39. Anti-rotation member 41 depends downward from plate 39 and has a polygonal exterior that inserts into and mates with the polygonal sides of form upper section 31. In this example, anti-rotation member 41 has four sides and is rectangular. Anti-rotation member 41 has a hole or passage 43 extending through it. Passage 43 is coaxial with an anti-rotation member axis 45 that is normal to plate 39. Passage 43 may be rectangular, as shown, or cylindrical.

A stop member or rod 47 mounts to plate 39, such as by threads or welding, and extends upward, parallel to and offset from fixture axis 45. Stop rod 47 may be cylindrical or other shapes. Stop rod 47 may be solid or tubular. A safety member or guard 49 may be mounted to plate 39 on an opposite side of passage 43. Safety guard 49 may be a flat plate and need not extend upward from plate 39 as high as the upper end of stop rod 47. Safety guard 49 may be in a plane parallel to an outer side edge 50 of plate 39. Outer side edge 50 is farther from fixture axis 45 than safety guard 49, defining a foot rest 51 on the upper side of plate 39 between safety guard 49 and outer edge 50. Foot rest 50 has a width selected between safety guard 49 and outer edge 50 to receive a boot of a worker.

Figure 4:
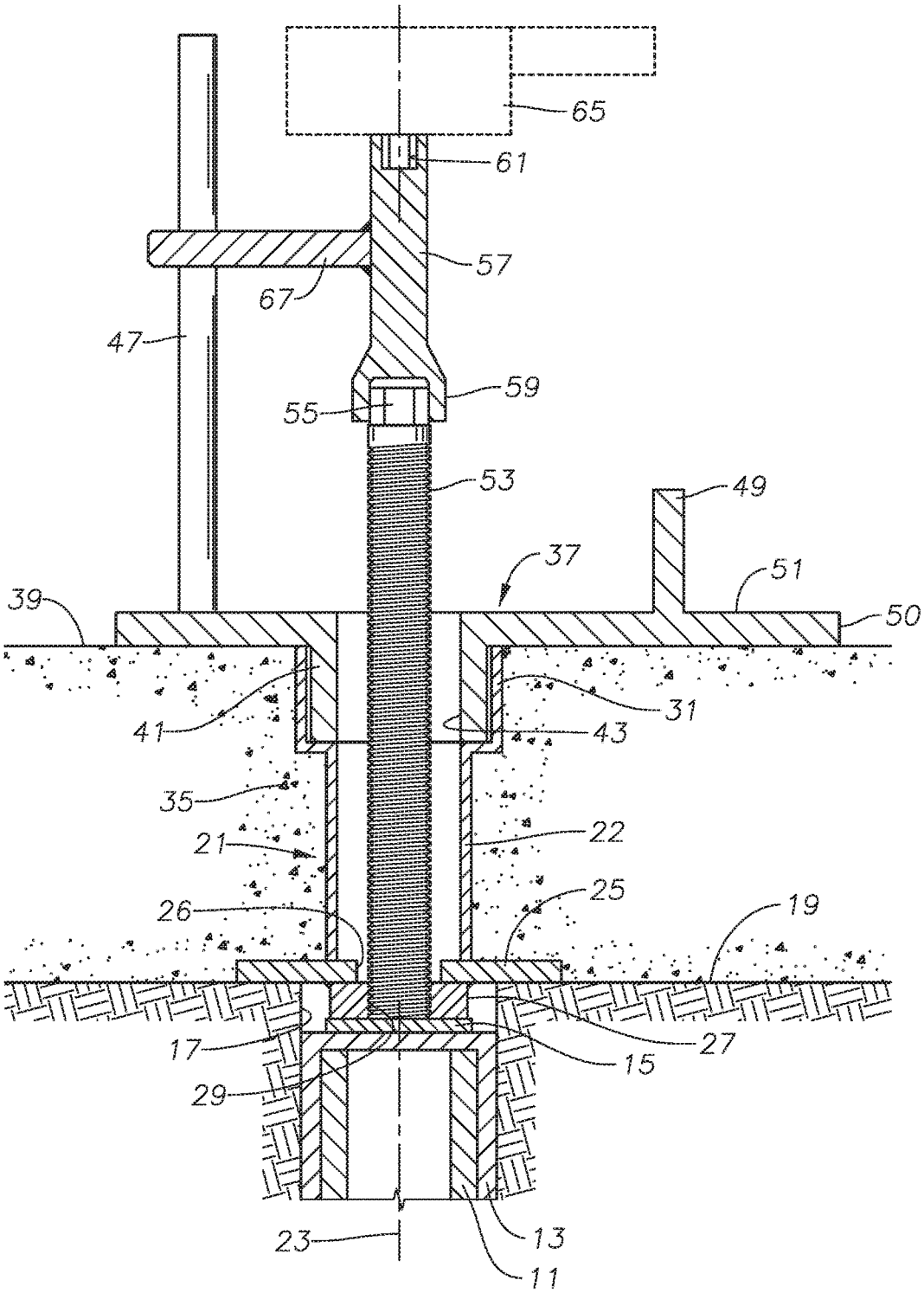
FIG. 4 is sectional view of part of the work station fixture of FIG. 3 installed on the form and a threaded rod in engagement with a nut of the form, prior to lifting the slab foundation.

FIG. 4 shows fixture 37 installed on slab 35 over one of the cavities 17. Anti-rotation member 41 inserts closely into polygonal upper section 31, preventing rotation of fixture 37 around cavity axis 23. Fixture axis 45 (FIG. 3) will coincide with cavity axis 23. Stop bar 47 will be parallel to cavity axis 23. A worker will install a threaded rod 53 in the cavity 17 of each lifting station, either before or after placement of fixture 37. The worker will rotate the threads of threaded rod 53 in threaded aperture 29 of nut 27 to an initial hand tight position. The hand tight position may place the lower end of threaded rod 53 into abutment with bearing plate 15. Threaded rod 53 has a polygonal upper end 55 that will be located an initial distance above slab 35. The initial distance is approximately the distance that slab 35 will be lifted.

An adapter 57 has a lower polygonal socket or receptacle 59 that slides over and couples to threaded rod upper end 55. Adapter 57 is a rod-like member having a drive head or member 61 on its upper end, which may also be a polygonal socket. A conventional power tool 65, such as an air driven tool with a torque converter, has a drive member that fits into adapter receptacle 61. Power tool 65, shown schematically, is capable of rotating threaded rod 53 at a fairly slow speed but at high torque.

Adapter 57 has a stop member or bar 67 extending laterally from it perpendicular to cavity axis 23. Adapter stop bar 67 has a length greater than a distance from cavity axis 23 to fixture stop rod 47. Adapter stop bar 67 may have other configurations than a cylindrical rod. Adapter stop bar 67 may attach to adapter 57 by welding or other techniques.

As power tool 65 rotates threaded rod 53, adapter stop bar 67 will swing around and contact or strike fixture stop bar 47 just before a 360 degree turn of rotation, preventing further rotation past one turn of threaded rod 53. To rotate an additional turn, the worker lifts adapter 57 from threaded rod 53, positions adapter stop bar 67 on the opposite or start side of stop rod 47, and re-couples adapter receptacle 59 to threaded rod upper end 55. The worker can then actuate power tool 65 to rotate threaded rod 53 one additional turn until adapter stop bar 67 again contacts fixture stop rod 47. Each turn of threaded rod 53 will be 360 degrees less a few degrees proportional to the width of fixture stop rod 47.

During the lifting operation, a single worker with a single power tool 65 may perform the lifting operation at several or all lift stations. After rotating threaded rod 53 one turn at one lift station, the worker can move to an adjacent lift station, bringing along with him adapter 57 and power tool 65. Alternately, a separate adapter 57 could remain with each lift station until slab 35 is entirely lifted. He would rotate the threaded rod 53 of each lift station one turn, then move to the adjacent lift station. Each turn of threaded rod 53 causes nut 37 and nut support plate 25 to move upward, elevating slab 35 by an increment proportional to the pitch of the threads on threaded rod 53. During each rotation, the lower end of threaded rod 53 bears against and rotates on bearing plate 15.

Once reaching the desired height of slab 35 above grade 19, the worker removes each fixture 37 and adapter 57. Threaded rod 53 will remain in place, with its upper end 61 recessed within form 21. Optionally, a cover could be placed over each of the lifting stations after 35 is at the desired height.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. For example, fixture 37 could be moved from one lift station to another during the lifting operation rather than having a separate fixture 37 for each lift station. Further, portions of form 21, such as polygonal upper section 31 and tubular intermediate portion 22, could be removed after slab 35 hardens and before installing the threaded rods 53.

The invention claimed is:

1. A method for lifting a slab foundation, comprising:

installing at least one pier into a grade;

positioning a form with a threaded aperture and polygonal upper end over the pier;

pouring concrete around the form and allowing the concrete to harden into a slab foundation, defining a cavity with a polygonal receptacle at an upper side of the slab foundation;

installing a fixture on the upper side of the slab foundation, the fixture having a polygonal anti-rotation member that inserts into the polygonal receptacle and has a longitudinal axis, the fixture having an upward extending fixture stop member laterally offset from the axis;

inserting a threaded rod into the cavity and rotating the threaded rod through the threaded aperture;

installing a tool adapter on an upper end of the threaded rod, the adapter having an adapter stop member extending laterally relative to the axis;

rotating the tool adapter and the adapter stop member about the axis, lifting the slab foundation until the adapter stop member engages a stop side of the fixture stop member; then removing the adapter, placing the adapter stop member adjacent a start side of the fixture stop member, then again rotating the tool adapter, further lifting the slab foundation until the adapter stop member again engages the stop side of the fixture stop member.

2. The method according to claim 1, wherein again rotating the tool adapter again comprises rotating the adapter stop member less than 360 degrees about the axis.

3. The method according to claim 1, wherein installing the fixture on the upper side of the slab foundation comprises inserting the polygonal anti-rotation member into the polygonal upper end of the form.

4. The method according to claim 1, wherein:

installing the fixture on the upper side of the slab foundation further comprises providing the fixture with an upward-extending safety guard on an opposite side of the anti-rotation member from the fixture stop member and inward from an outer edge of the fixture to define a foot rest on the fixture between the outer edge of the fixture and the safety-guard.

5. The method according to claim 1, further comprising:

after lifting the slab foundation to a selected height, removing the fixture from the slab foundation.

6. The method according to claim 1, wherein:

positioning the form comprises placing a lower portion of the form onto the grade.

7. The method according to claim 1, wherein:

rotating the threaded rod through the threaded aperture comprises rotatably engaging a lower end of the threaded rod with an upper end of the pier.

8. The method according to claim 1, wherein:

the threaded rod passes through a hole in the anti-rotation member.

9. A method for lifting a slab foundation above a support pier, comprising:

(a) installing first and second piers into a grade;

(b) positioning a first form with a threaded aperture and polygonal upper end over the first pier;

(c) positioning a second form with a threaded aperture and polygonal upper end over the second pier;

(d) pouring concrete around the first and second forms and allowing the concrete to harden into a slab foundation, each of the first and second forms defining a cavity with a polygonal receptacle at an upper side of the slab foundation;

(e) inserting first and second threaded rods into the first and second forms, respectively, and rotating the threaded rods through the threaded apertures of the first and second forms, respectively;

(f) installing first and second fixtures on the upper side of the slab foundation, the first and second fixtures each having a polygonal anti-rotation member that has a longitudinal axis and inserts into the polygonal receptacle of the cavity of one of the forms, the first and second threaded rods each extending upward coaxially through the anti-rotation members of the first and second fixtures, respectively, each of the first and second fixtures having an upward extending fixture stop member laterally offset from the axis;

(g) inserting a tool adapter onto the first threaded rod, the adapter having an adapter stop member extending laterally relative to the axis of the anti-rotation member of the first fixture;

(h) rotating the adapter, the adapter stop member and the first threaded rod, lifting the slab foundation until the adapter stop member abuts a stop side of the fixture stop member of the first fixture; and (i) removing the adapter, placing the adapter on an upper end of the second threaded rod and rotating the adapter, the second threaded rod, and the adapter stop member, lifting the slab foundation until the adapter stop member abuts a stop side of the fixture stop member of the second fixture.

10. The method according to claim 9, further comprising:

alternately repeating steps (h) and (i) until the slab foundation reaches a selected height above the ground.

11. The method according to claim 9, wherein steps (h) and (i) comprise:

placing the adapter stop member adjacent a start side of the fixture stop member before rotating the tool adapter.

12. The method according to claim 9, wherein step (h) and step (i) each comprise swinging the adapter stop member less than 360 degrees about the axis.

13. The method according to claim 9, wherein installing the first and second fixtures on the upper side of the slab foundation comprises inserting the polygonal anti-rotation members of the first and second fixtures into the polygonal upper ends of the first and second forms, respectively.

14. A lift station for lifting a slab foundation above a support pier, comprising:

a tubular form configured for positioning on top of the pier prior to pouring the foundation, the form having a polygonal form receptacle at an upper end of the form, a threaded aperture below the form receptacle, and an exterior of the form configured to be bonded within concrete after the foundation has been poured;

a fixture plate on top of the foundation after the foundation has been poured around the form and the concrete cured;

an anti-rotation member depending from the fixture plate and having a polygonal exterior that inserts closely into the form receptacle to prevent rotation of the fixture plate, the anti-rotation member having a longitudinal axis and a coaxial hole;

a fixture stop member mounted to and extending upward from the plate offset from the axis;

a threaded rod that extends through the hole in the anti-rotation member and into threaded engagement with the threaded aperture;

a rotatable adapter for a tool that couples to an upper end of the threaded rod to rotate the threaded rod with the tool; and an adapter stop member secured to and extending laterally from the adapter for rotation therewith, the adapter stop member being positioned to contact a stop side of the fixture stop member and stop rotation of the threaded rod after each turn, requiring removal of the adapter from the threaded rod and repositioning of the adapter stop member adjacent a start side of the fixture stop member in order to make an additional turn.

15. The lift station according to claim 14, further comprising a safety guard member secured to and protruding upward from the plate on an opposite side of the axis from the fixture stop member.

16. The lift station according to claim 14, wherein the plate has an outer edge farther from the axis than the safety guard member, defining a foot rest for a worker between the outer edge and the safety guard member.

17. The lift station according to claim 14, wherein:

the fixture stop member comprises a rod.

18. The lift station according to claim 14, wherein:

the adapter stop member comprises a bar.

19. The lift station according to claim 14, further comprising:

a bearing plate between a lower end of the threaded rod and the upper end of the pier.

* * * * *